US005412394A

United States Patent [19]

Milroy

[11] Patent Number: 5,412,394

[45] **Date of Patent: * May 2, 1995**

[54] CONTINUOUS TRANSVERSE STUB ELEMENT DEVICE ANTENNA ARRAY CONFIGURATIONS

[75] Inventor: William W. Milroy, Playa del Rey, Calif.

[73] Assignee: Hughes Aircraft Company, Los Angeles, Calif.

[ * ] Notice: The portion of the term of this patent subsequent to Nov. 30, 2010 has been disclaimed.

[21] Appl. No.: 104,467

[22] Filed: Aug. 10, 1993

Related U.S. Application Data

[63] Continuation of Ser. No. 751,282, Aug. 29, 1991, now Re. 5,266,961.

[51] Int. Cl.[6] ..... H01Q 13/00

[52] U.S. Cl. ..... 343/785; 343/772; 343/767

[58] Field of Search ..... 343/771, 772, 767, 770, 343/785, 786; 29/600; 333/237, 239, 248; H01Q 13/00

[56] References Cited

U.S. PATENT DOCUMENTS

| | | | |
|---|---|---|---|
| 4,970,522 | 11/1990 | Niman | 343/771 |
| 5,172,127 | 12/1992 | Josefsson | 343/771 |
| 5,210,543 | 5/1993 | Kurtz | 343/771 |
| 5,266,961 | 11/1993 | Milroy | 343/772 |

*Primary Examiner*—Donald Hajec
*Assistant Examiner*—Tan Ho
*Attorney, Agent, or Firm*—L. A. Alkov; W. K. Denson-Low

[57] ABSTRACT

A dielectric material is formed into a structure having two parallel broad surfaces with one or more raised integral portions extending transversely across at least one of the broad surfaces. The exterior is uniformly conductively coated resulting in a parallel plate waveguide having a continuous transverse stub element disposed adjacent one plate thereof. Purely reactive elements are formed by leaving the conductive coating on the terminus of the stub element, or by narrowing the terminus of the stub element. Radiating elements are formed when stub elements of moderate height are opened to free space. Radiating, coupling and/or reactive continuous transverse stub elements may be combined in a common parallel plate structure in order to form a variety of microwave, millimeter wave and quasi-optical components including integrated filters, couplers and antenna arrays. Fabrication of the dielectrically-loaded continuous transverse stub element can be efficiently accomplished by machining, extruding or molding the dielectric structure, followed by uniform conductive plating in order to form the parallel plate transmission line. In the case of antenna applications, machining or grinding is performed on the stub terminus to expose the dielectric material at the end of the stub element.

8 Claims, 8 Drawing Sheets

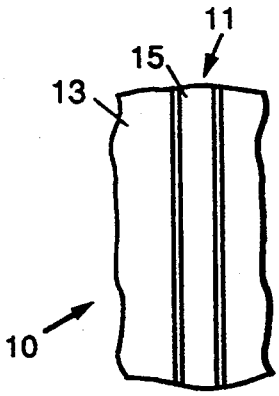
FIG. 1a.
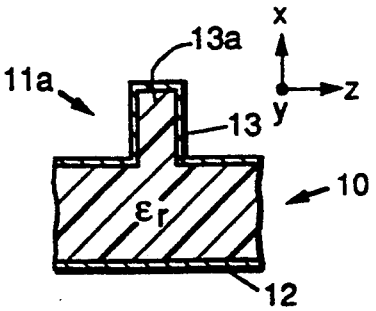
FIG. 2.
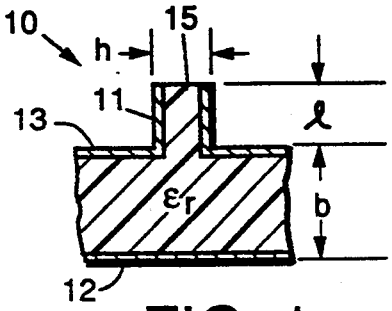
FIG. 1.
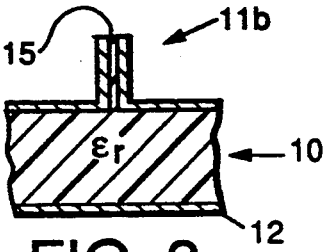
FIG. 3.
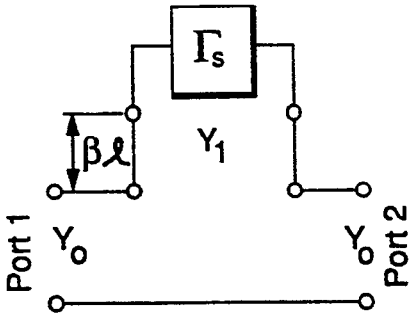
FIG. 5.
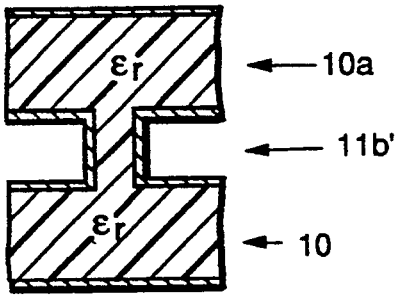
FIG. 4.
FIG. 6.
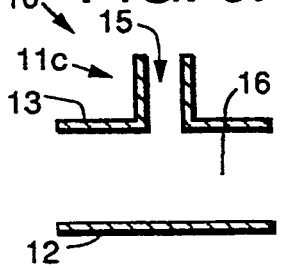
FIG. 7a.
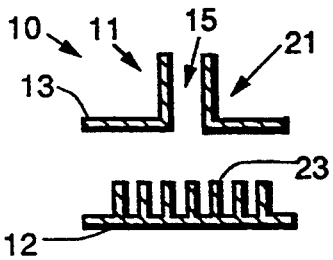
FIG. 7b.
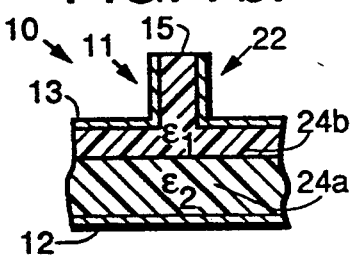

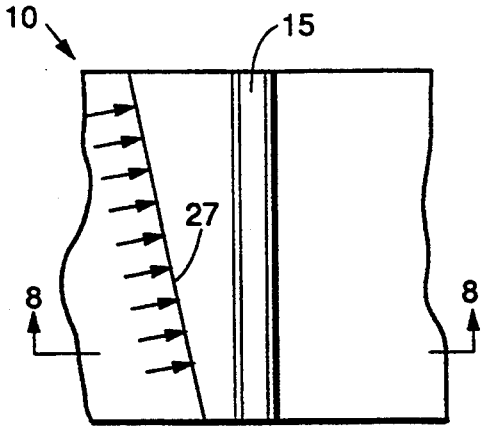
FIG. 8a.
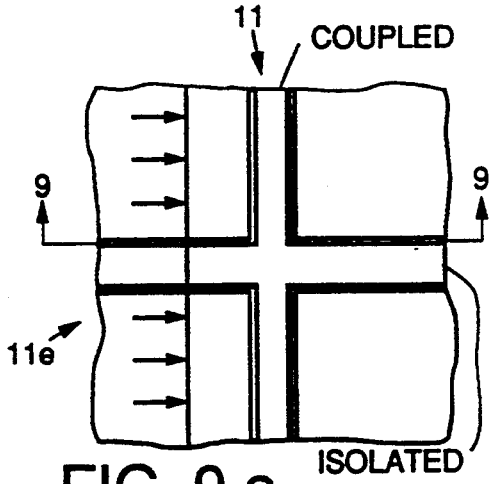
FIG. 9 a.
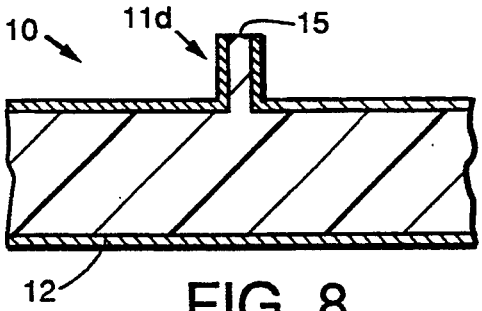
FIG. 8.
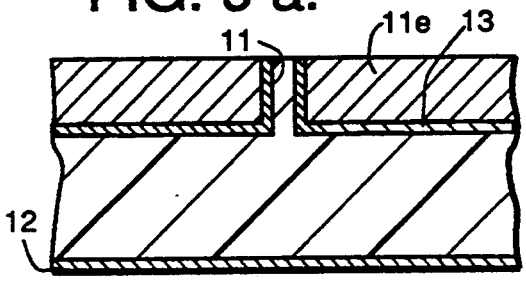
FIG.9.
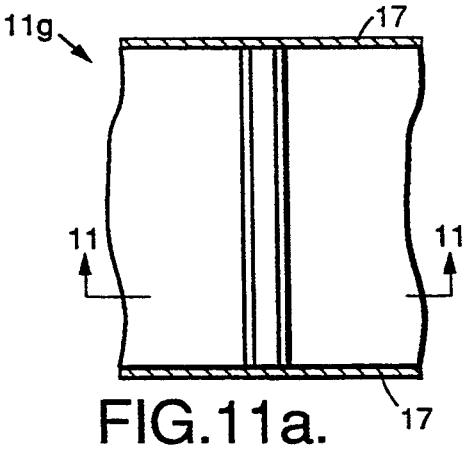
FIG.11a.
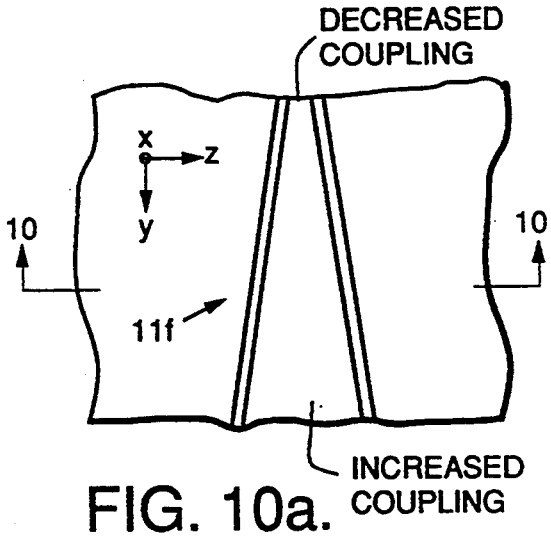
FIG. 10a.
FIG.11.
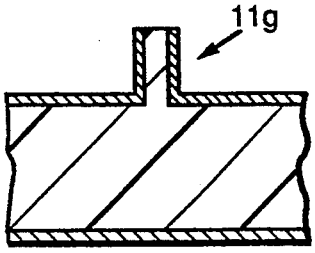
FIG. 10.
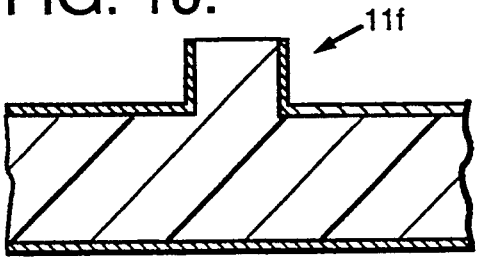

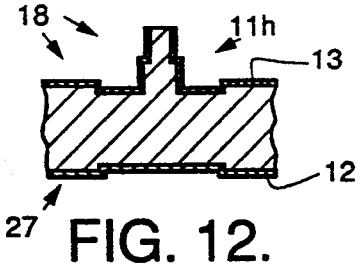
FIG. 12.
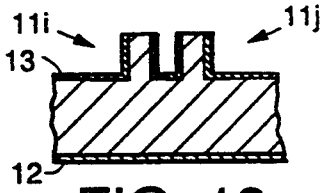
FIG. 13.
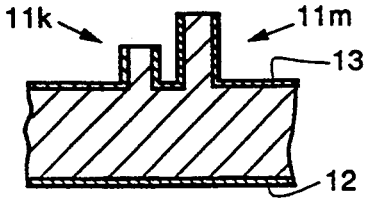
FIG. 14.
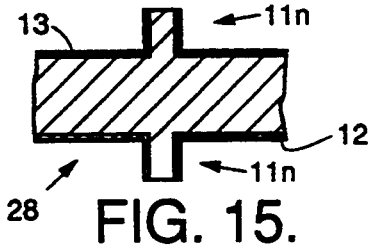
FIG. 15.
FIG. 17a.
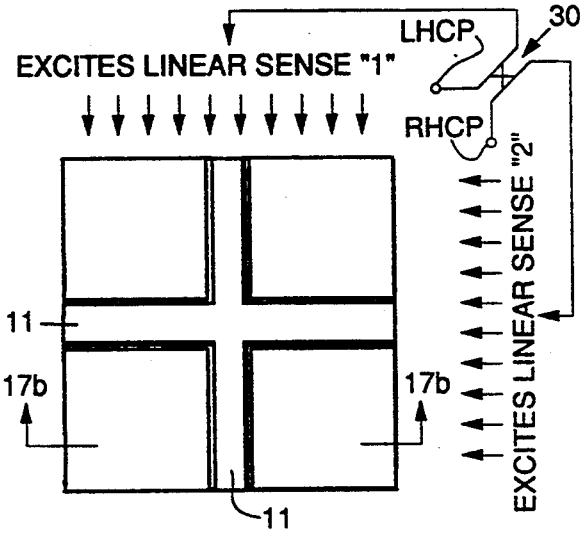
FIG. 16a.
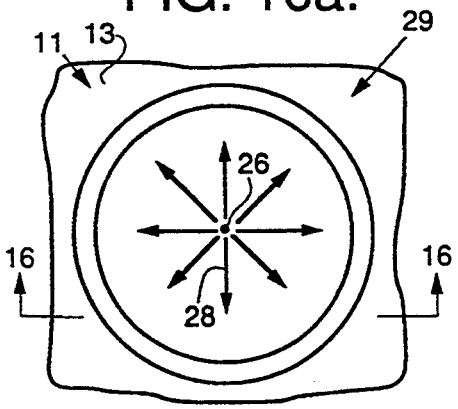
FIG. 16.
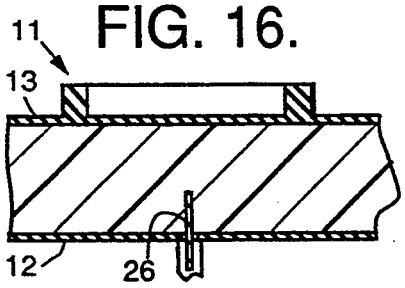
FIG. 17b.
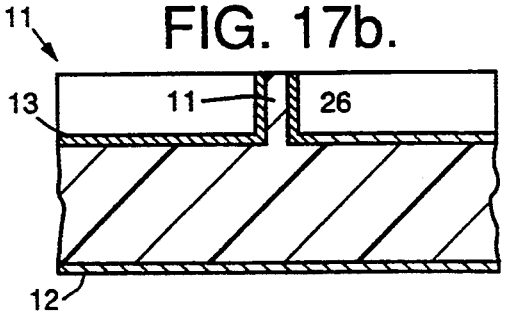

FIG. 21.
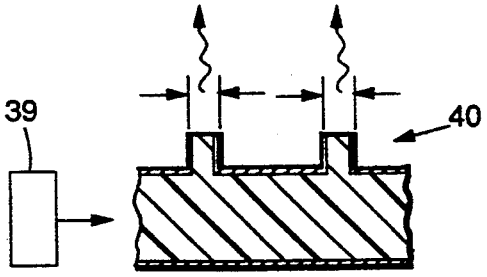
FIG. 22.
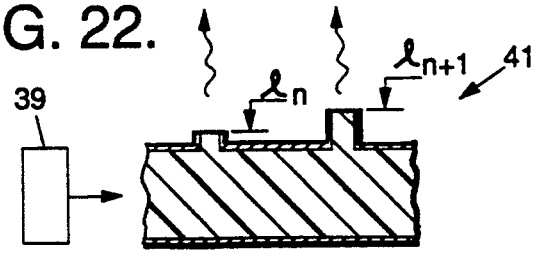
FIG. 24.
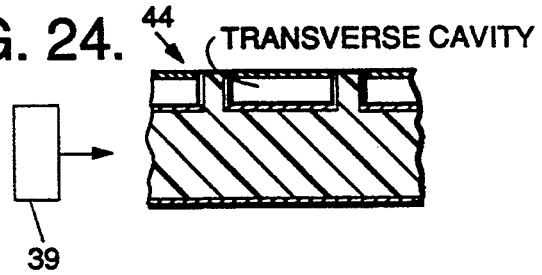
FIG. 23.
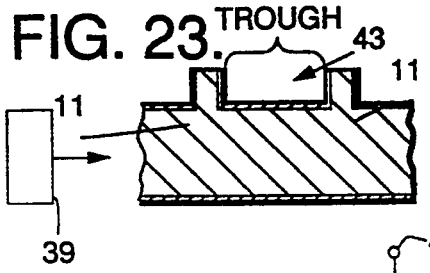
FIG. 26.
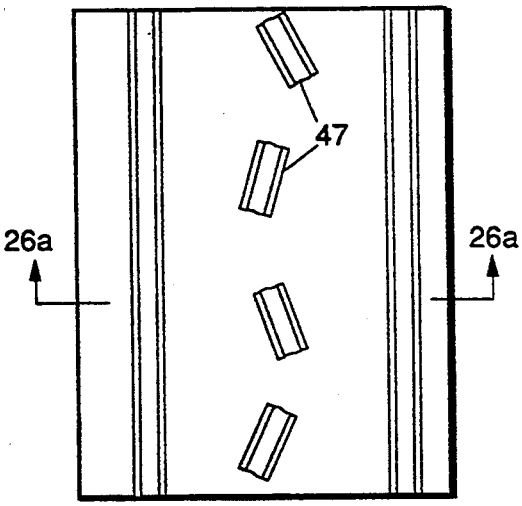
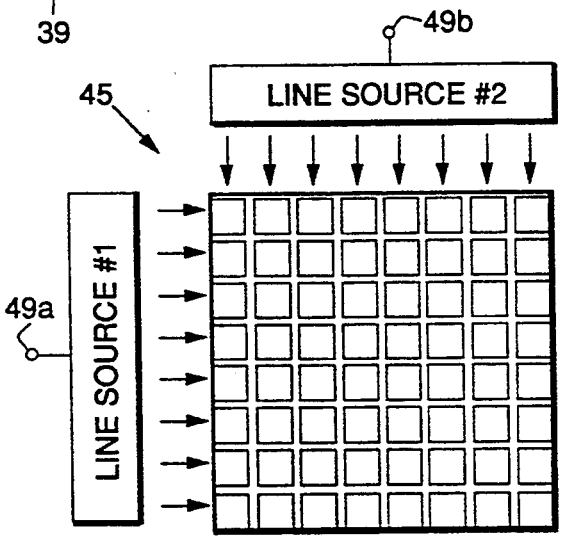
FIG. 25.
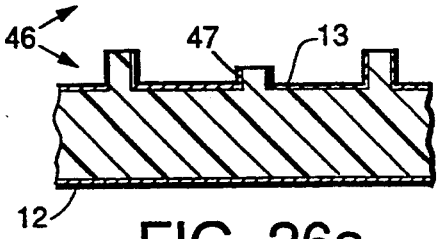
FIG. 26a.
FIG. 27.
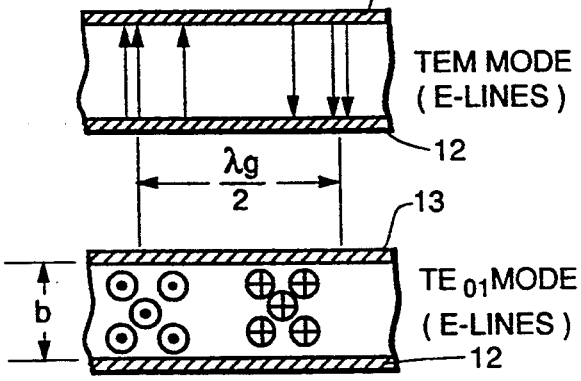
FIG. 27a.

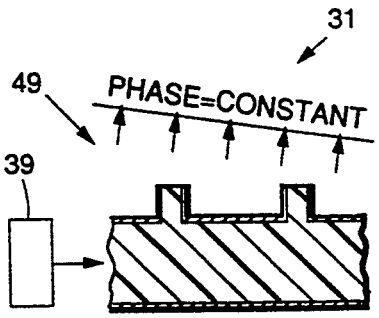
FIG. 28.
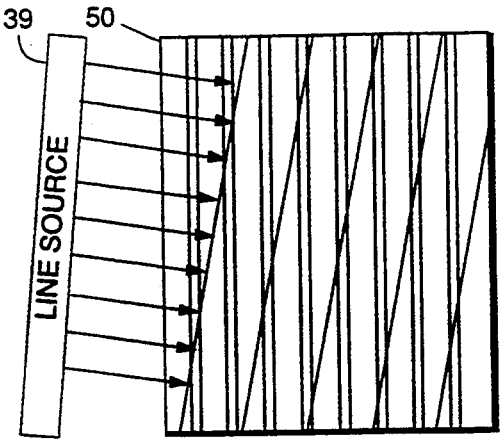
FIG. 29.
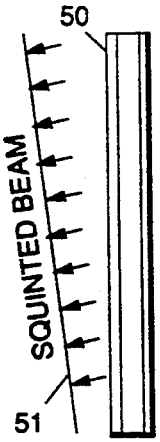
FIG. 29a
FIG. 30.
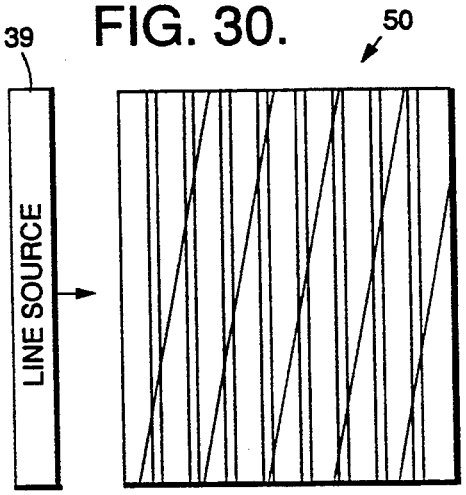
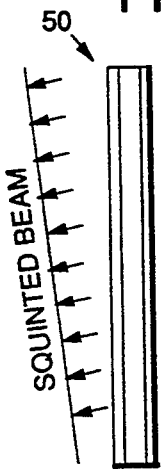
FIG. 30a.
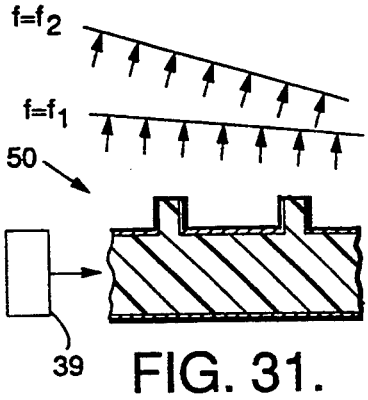
FIG. 31.
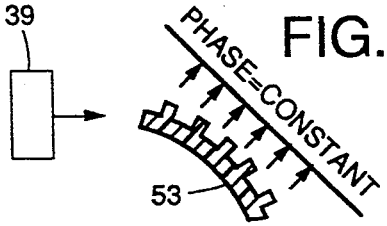
FIG. 32.
FIG. 32a.
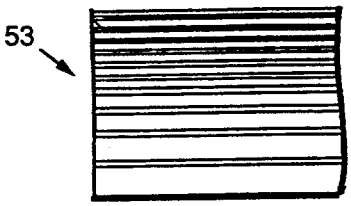
FIG. 33.
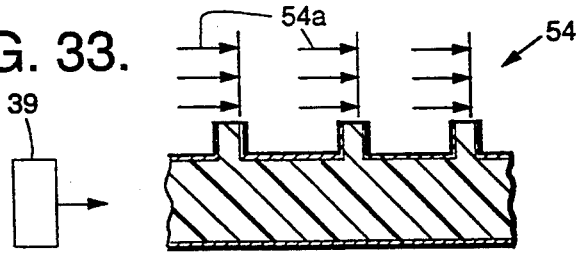

FIG. 39.
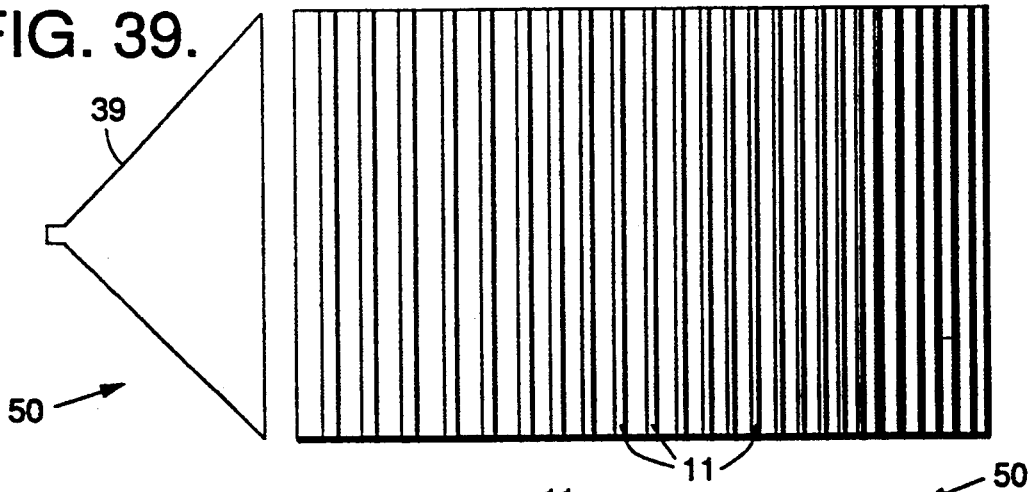
FIG.40.
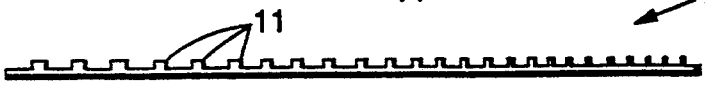
FIG. 41.
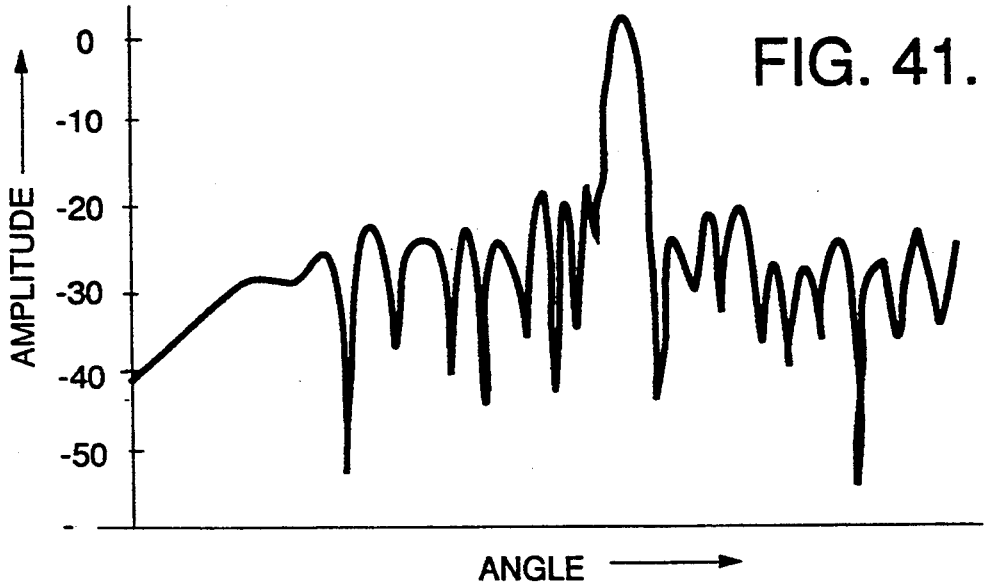
FIG. 30b.
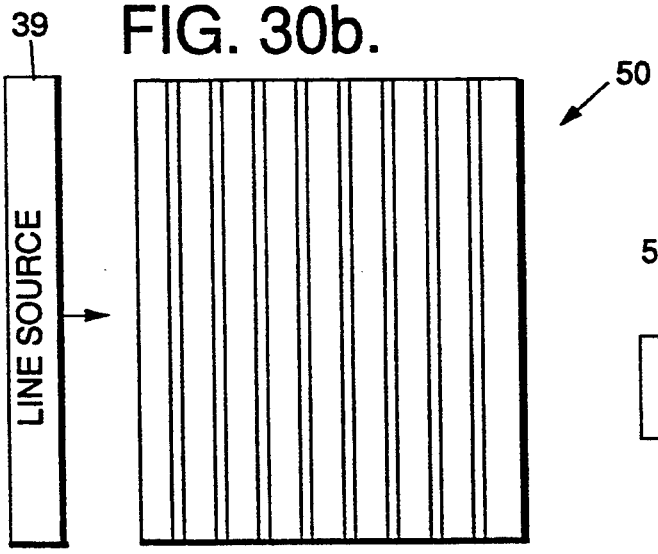
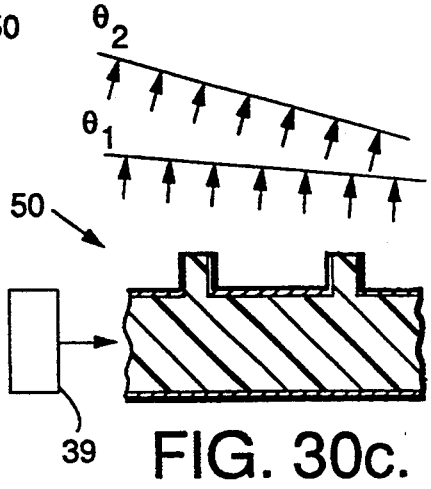
FIG. 30c.

CONTINUOUS TRANSVERSE STUB ELEMENT DEVICE ANTENNA ARRAY CONFIGURATIONS

This is a continuation of application Ser. No. 07/751,282 filed Aug. 29, 1991 now U.S. Pat. No. 5,266,961

BACKGROUND

The present invention relates generally to antennas and transmission lines, and more particularly, to a continuous transverse stub disposed on one or both conductive plates of a parallel-plate waveguide, and antenna arrays, filters and couplers made therefrom.

At microwave frequencies, it is conventional to use slotted waveguide arrays, printed patch arrays, and reflector and lens systems. However, as the frequencies in use increase to 20 GHz and above, it becomes more difficult to use these conventional microwave elements.

The present invention relates to devices useful at frequencies as high as 20 GHz and up known as millimeter-wave and quasi-optical frequencies. Such devices take on a nature similar to strip line, microstrip or plastic antenna arrays or transmission lines. Such devices are fabricated in much the same way as optical fibers are fabricated.

Conventional slotted planar array antennas are difficult to use above 20 GHz because of their complicated design. This, in conjunction with the precision and complexity required in the machining, joining, and assembly of such antennas, further limits their use.

Printed patch array antennas suffer from inferior efficiency due to their high dissipative losses, particularly at higher frequencies and for larger arrays. Frequency bandwidths for such antennas are typically less than that which can be realized with slotted planar arrays. Sensitivity to dimensional and material tolerances is greater in this type of array due to the dielectric loading and resonant structures inherent in their design.

Reflector and lens antennas are generally employed in applications for which planar array antennas are undesirable, and for which the additional bulk and weight of a reflector or lens system is deemed to be acceptable. The absence of discrete aperture excitation control in traditional reflector and lens antennas limit their effectiveness in low sidelobe and shaped-beam applications.

Filters at millimeter-wave and quasi-optical frequencies suffer from relatively low Q-factors due to high dissipative element and interconnect losses and from relative difficulty in fabrication due to dimensional tolerances.

SUMMARY OF THE INVENTION

A continuous transverse stub element residing in one or both conductive plates of a parallel plate waveguide is employed as a coupling, reactive, or radiating element in microwave, millimeter-wave, and quasi-optical coupler, filter, or antenna. The most general form of the continuous transverse stub element comprises an antenna that includes the following elements: (1) a dielectric element comprising a first portion and a second portion that extends generally transverse to the first portion that forms a transverse stub that protrudes from a first surface of the first portion; (2) a first conductive element disposed coextensive with the dielectric element along a second surface of the first portion; and (3) a second conductive element disposed along the first surface of the dielectric element and disposed along transversely extending edgewalls formed by the second portion of the dielectric element. The numerous other variations of the transverse stub element are formed by modifying the height, width, length, cross section, and number of stub elements, and by adding additional structures to the basic stub element.

Purely-reactive stub elements are realized through conductively terminating (short circuit) or narrowing (open circuit) the terminus of the stub. Radiating elements are formed when stubs of moderate height are opened to free space. Precise control of element coupling or excitation (amplitude and phase) via coupling of the parallel plate waveguide modes is accomplished through variation of longitudinal stub length, stub height, parallel plate separation, and the constituent properties of the parallel plate and stub media.

The continuous transverse stub element may be arrayed in order to form a planar aperture or structure of arbitrary area, comprised of a linear array of continuous transverse elements fed by a conventional line-source, or sources. Conventional methods of coupler, filter, or antenna array synthesis and analysis may be employed in either the frequency or spatial domains to construct stub elements and arrays to meet substantially any application.

The principles of the present invention are applicable to all planar array applications at microwave, millimeter-wave, and quasi-optical frequencies. Shaped-beams, multiple-beams, dual-polarization, dual-bands, and monopulse functions are achieved using the present invention. In addition, a planar continuous transverse stub array is a prime candidate to replace reflector and lens antennas in applications for which planar arrays have heretofore been inappropriate due to traditional bandwidth and/or cost limitations.

Additional advantages in millimeter-wave and quasi-optical filter and coupler designs are realized due to the enhanced producibility and relative low-loss (high "Q") of the continuous transverse stub element as compared to stripline, microstrip, and waveguide elements. Filter and coupler capabilities are fully-integrated with radiator functions in a common structure.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 1 and 1*a* illustrate a continuous transverse stub element in accordance with the principles of the present invention;

FIGS. 2, 3, and 4 depict the continuous transverse stub element in short-circuit, open-circuit, and coupler configurations, respectively;

FIG. 5 depicts a simplified equivalent circuit for the continuous transverse stub element based on simple transmission-line theory;

FIG. 6 illustrates a nondielectrically loaded continuous transverse stub element;

Figure 18:
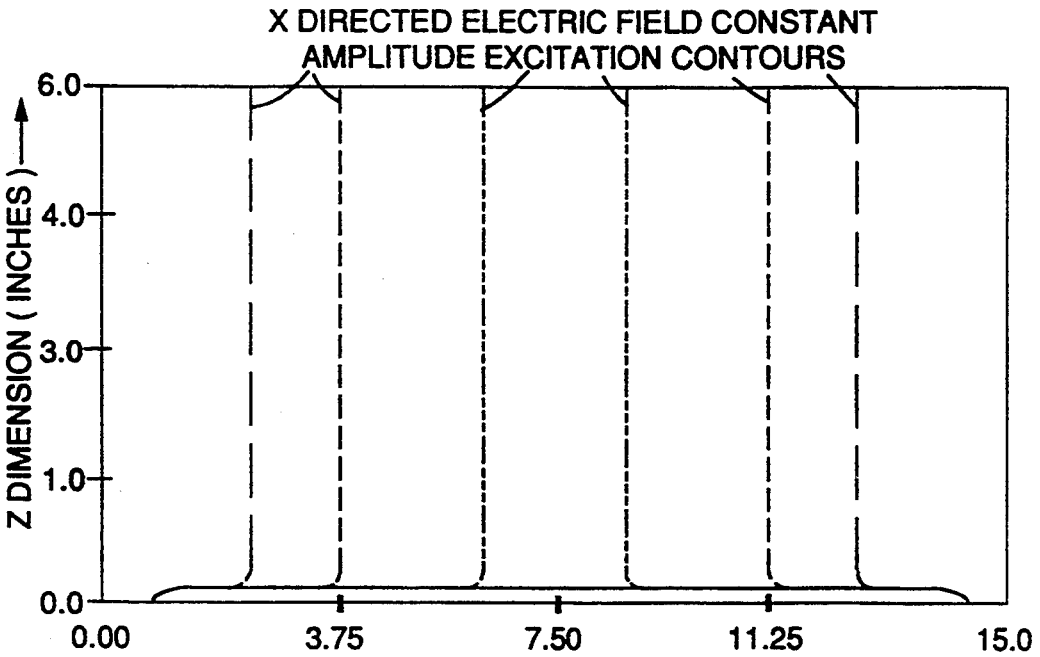
Figure 19:
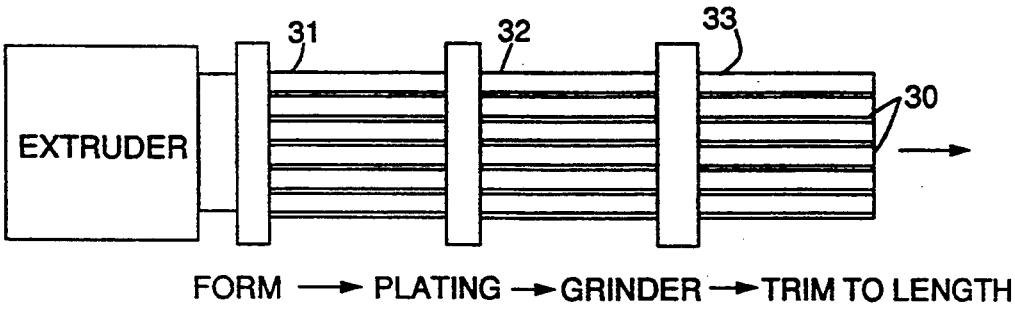
Figure 19A:
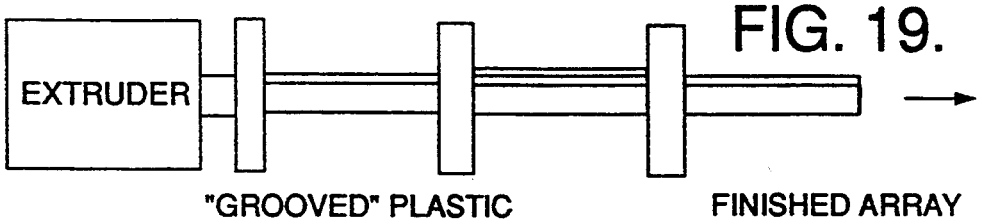
Figure 20:
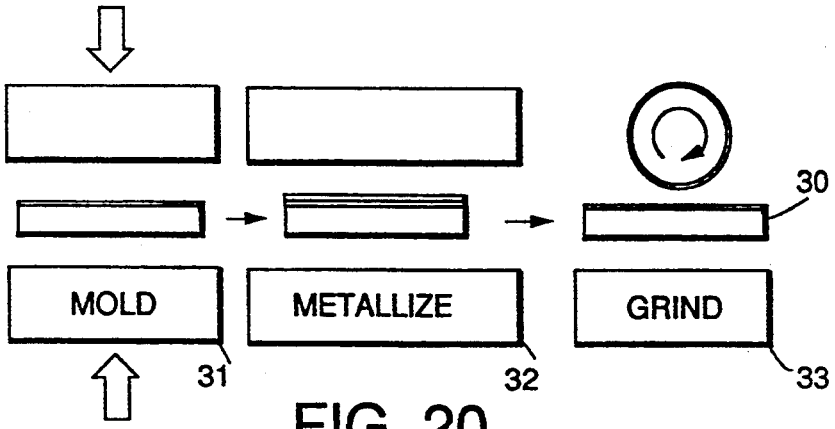
Figure 34:
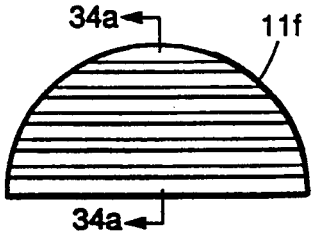
Figure 34A:
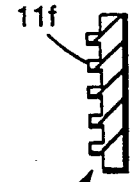
Figure 35:
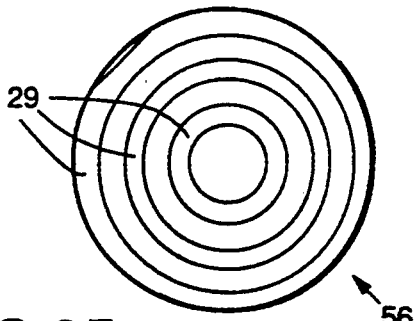
Figure 34B:
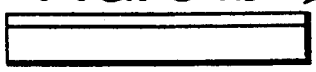
Figure 35A:
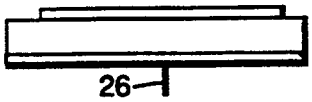
Figure 38:
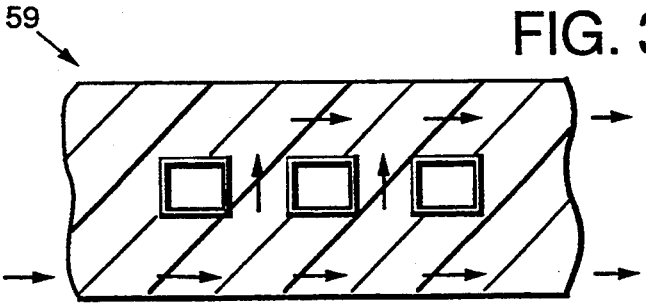
Figure 38A:
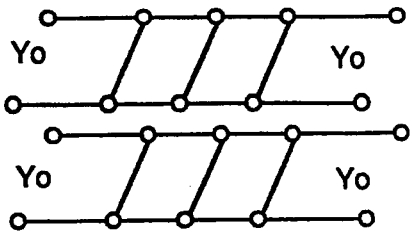

FIGS. *7a* and *7b* illustrate slow-wave artificial dielectric and inhomogeneous structures employing the continuous transverse stub element of the present invention;

FIGS. 8 and 8*a* illustrate a continuous transverse stub element of the present invention designed for oblique incidence;

FIGS. 9 and 9*a* illustrate two orthogonal continuous transverse stub elements of the present invention designed for dual polarization operation;

FIGS. 10 and 10*a* illustrate parameter variation in the transverse dimension;

FIGS. 11 and 11 a illustrate a finite width element;

FIG. 12 illustrates a multi-stage stub/transmission section;

FIG. 13 illustrates paired-elements comprising a matched couplet;

FIG. 14 illustrates radiating and non-radiating stub pairs comprising a matched couplet;

FIG. 15 illustrates a double-sided radiator/falter,

FIGS. 16 and 16*a* illustrate a radial element;

FIG. 17 and 17*a* illustrate circularly polarized orthogonal elements;

FIG. 18 illustrates theoretical constant amplitude contours for an x-directed electric field within an air-filled 6 inch by 15 inch parallel plate region fed by a discrete linear array located at y=0 and radiating at a frequency of 60 GHz;

FIGS. 19 and 19*a* illustrate a typical continuous extrusion process whereby the stubs of the continuous transverse stub array structure are formed, metallized and trimmed in a continuous sequential operation;

FIG. 20 illustrates a discrete process by which individual continuous transverse stub array structures are molded/formed, metallized and trimmed in a sequence of discrete operations;

FIG. 21 illustrates a pencil beam antenna array;

FIG. 22 illustrates a complex shaped-beam antenna;

FIG. 23 illustrates relatively wide continuous transverse conductive troughs formed between individual continuous transverse stub elements;

FIG. 24 illustrates a slotted waveguide cavity exploitation of the available trough region between adjacent stub elements;

FIG. 25 illustrates a pair of orthogonally-oriented continuous transverse stub arrays that may be utilized to realize a dual-polarization radiation pattern;

FIGS. 26 and 26*a* illustrate thick or thin inclined slots disposed in inter-element trough regions;

FIGS. 27 and 27*a* illustrate illustrates the electric field components for TEM and $TE_{01}$ modes;

FIG. 28 illustrates an intentional fixed or variable beam squint;

FIGS. 29 and 29*a* illustrate scanning by mechanical line-feed variation;

FIGS. 30 and 30*a* illustrate scanning by line-feed phase velocity variation;

FIGS. 30*b* and 30*c* illustrate scanning and tuning by parallel plate phase velocity variation;

FIG. 31 illustrates scanning by frequency;

FIGS. 32 and 32*a* illustrate a conformal array;

FIG. 33 illustrates an endfire array;

FIGS. 34*a* and 34*b* illustrate a non-separable shared array;

FIGS. 35 and 35*a* illustrate a continuous transverse stub array configured in radial form;

FIGS. 36, 36*a*, 37 and 37*a* illustrate filters employing non-radiating reactive continuous transverse stub elements;

FIGS. 38 and 38*a* illustrate couplers employing non-radiating reactive continuous transverse stub elements;

FIG. 39 is a top view of an embodiment of a continuous transverse stub array in accordance with the present invention;

FIG. 40 is a side view of the continuous transverse stub array of FIG. 39; and FIG. 41 illustrates a measured E-plane pattern for the continuous transverse stub array of FIGS. 39 and 40 measured at a frequency of 17.5 GHz.

DETAILED DESCRIPTION

FIGS. 1 and 1*a* illustrate cutaway side and top views of a continuous transverse stub element 11 (or stub 11 ) in its most common homogeneous, dielectrically-loaded, form, that forms pan of a parallel plate waveguide or transmission line 10, having first and second parallel terminus plates 12, 13. The stub element 11 has a stub radiator 15 exposed at its outer end, which is a portion of dielectric material that is disposed between the fast and second parallel terminus plates 12, 13. One of the terminus plates 13 covers the edgewalls of the stub element 11. Incident z-traveling waveguide modes, launched via a primary line feed of arbitrary configuration, have associated with them longitudinal, z-directed, electric wall current components which are interrupted by the presence of a continuous or quasi-continuous, y-oriented, transverse stub element 11, thereby exciting a longitudinal, z-directed, displacement current (electric field) across the stub element 11—parallel plate 12, 13 interface. This induced displacement current in turn excites equivalent x-traveling waveguide mode(s) in the stub element 11 which travel to its terminus and either radiate into free space (for the radiator case shown in FIGS. 1 and 1*a*), are coupled to a second parallel plate region (for the coupler case shown in FIG. 4), or are totally reflected (for the purely-reactive filter case shown in FIGS. 2 and 3). For the radiator case, the electric field vector (polarization) is linearly-oriented transverse (z-directed) to the continuous transverse stub element 11. Radiating, coupling, and/or reactive continuous transverse stub elements may be combined in a common parallel plate structure in order to form a variety of microwave, millimeter-wave, and quasi-optical components including integrated filters, couplers, and antenna arrays.

FIGS. 2, 3, and 4 depict the basic continuous transverse stub element 11 in its short-circuit, open-circuit, and coupler configurations, respectively. In FIG. 2, the second parallel plate 13 bridges across the end of the stub element 11 via metalization 13*a* creating a short circuit stub element 11*a*. In FIG. 3, the second parallel plate 13 is non-bridging and the element 11*b* is narrowed, creating an open circuit stub element 11*b*. In FIG. 4, both ends of the stub element 11 are open to respective first and second parallel plate waveguides 10, 10*a*, thus creating a coupling stub element 11*b*'.

Back-scattered energy from respective ones of the parallel plate waveguide 10 and short circuit stub element 11*a*, open circuit stub element 11*b* and free space, and coupling stub element 11*b*' and second waveguide 10*a* interfaces coherently interact with incident energy in the conventional transmission-line sense as is given by the following equations:

$$\hat{S}_{11} = \hat{S}_{22} = \frac{\alpha}{(1+\alpha)}$$

$$\hat{S}_{12} = \hat{S}_{21} = \frac{1}{(1+\alpha)}$$

$$|K|^2 = 1 - \frac{1+|\alpha|^2}{|1+\alpha|^2}, \text{ where}$$

-continued $$\alpha = \left(\frac{h}{2b}\right)\left[\frac{1 + \Gamma_S \exp^{-j2\beta 1 1}}{1 - \Gamma_S \exp^{-j2\beta 1 1}}\right], \Gamma_S = \frac{Y_0 - Y_S}{Y_0 + Y_S}.$$

These interactions are comprehensively modeled and exploited using standard transmission-line theory. Fringing effects at both interfaces are adequately modeled using conventional mode-matching techniques. The variable length (l) and height (h) of the coupling stub element 11 (FIG. 1 ) controls its electrical line length ($\beta_1 l$) and characteristic admittance ($Y_1$) respectively and in doing so, allows for controlled transformation of its terminal admittance (primarily dependent on h and $\epsilon_r$) back to the main parallel plate transmission line 10, whose characteristic admittance is governed by its height (b), and in this way allows for a wide range of discrete coupling values ($|K|$), equal to the coupled power over incident power, of $-3$ dB to less than $-35$ dB. Variations in the length of the coupling stub element 11 also allow for straightforward phase modulation of the coupled energy, as required in shaped-beam antenna and multi-stage filter applications.

FIG. 5 depicts the simplified equivalent circuit from which are derived scattering parameters ($S_{11}$, $S_{22}$, $S_{12}$, $S_{21}$) and coupling coefficient ($|K|^2$) for the continuous transverse stub element 11 based on simple transmission-line theory. Note that coupling values are chiefly dependent upon the mechanical ratio of the height (h) of the stub element 11 relative to the height (b) of the parallel plate waveguide 10, consistent with a simple voltage divider relationship. This mechanical ratio is independent of the operating frequency and dielectric constant of the structure, and the continuous transverse stub element 11 is inherently broadband and forgiving of small variations in mechanical and constituent material specifications. Consequently, $Y_S$ are set to infinity for a short-circuit, zero for an open-circuit, or $Y_2$ for a coupling configuration without loss of generality.

Fabrication of the dielectrically-loaded continuous transverse stub element 11 is efficiently accomplished through machining or molding of the dielectric structure, followed by uniform conductive plating in order to form the parallel plate transmission-line 10, and, in the case of antenna applications, machining or grinding of the terminus of the stub element 11 in order to expose the stub radiator 15 (FIG. 1 ). There are numerous variations upon the basic continuous transverse stub element 11 which may be useful in particular applications. These variations are described below.

A nondielectrically loaded stub element 11*c* is shown in FIG. 6. A low density foam 16 (comprising about 99% air), or air 16, may be employed as the transmission line medium for the continuous transverse stub element 11*c* in order to realize an efficient element for an endfire array or bandstop filter, for example. The nondielectrically loaded continuous transverse stub element 11*c* is particularly well-suited in such applications due to its broad pseudo-uniform E-plane element pattern, even at endfire.

Slow-wave and inhomogeneous structures 21, 22 are shown in FIGS. 7*a* and 7*b*. An artificial dielectric 23 (corrugated slow-wave structure 23) or multiple dielectric 24*a*, 24*b* (inhomogeneous structure 24) may be employed between the parallel plates 12, 13 in applications for which minimal weight, complex frequency dependence, or precise phase velocity control is required.

An oblique incidence stub element 11*d* is shown in FIGS. 8 and 8*a*, which show cutaway side and top views, respectively. Oblique incidence of propagating waveguide modes are achieved through mechanical or electrical variation of an incoming phase front 27 relative to the axis of the continuous transverse stub element 11*d* for the purpose of scanning the beam in the transverse (H-) plane. This variation is normally imposed through mechanical or electrical variation of the primary line feed exciting the parallel plate region. The precise scan angle of this scanned beam is related to the angle of incidence of the waveguide mode phase front 27 via Snell's law. That is, refraction occurs at the stub element 11*d*—free space interface in such a way as to magnify any scan angle imposed by the mechanical or electrical variation of the line feed. This phenomena is exploited in order to allow for relatively large antenna scan angles with only small variations in line feed orientation and phasing. Coupling values are pseudo-constant for small angles of incidence.

A longitudinal incidence stub element 11*e* is shown in FIGS. 9 and 9*a*, which show cutaway side and top views, respectively. A narrow continuous transverse stub element 11*e* does not couple dominant waveguide modes whose phase fronts are perpendicular to the axis of the stub element 11*e*. This characteristic is exploited through implementation of orthogonal continuous transverse stub radiator elements 11, 11*e* in a common parallel plate region comprised of parallel plates 12, 13. In this way, two isolated, orthogonally-polarized antenna modes are simultaneously supported in a shared aperture for the purpose of realizing dual-polarization, dual-band, or dual-beam capabilities.

Parameter variation in the transverse dimension is shown in FIGS. 10 and 10*a*, which show cutaway side and top views, respectively. Slow variation of the dimensions of the stub element 11 in the transverse (y-dimension) may be employed in order to realize tapered coupling in the transverse plane. This capability proves useful in antenna array applications in which non-separable aperture distributions are desirable and/or for non-rectangular array shapes. Such a modified element is known as a tapered or quasi-continuous transverse stub element 11*f*.

A finite width element 11*g* is shown in FIGS. 11 and 1 la, which show cutaway side and top views, respectively. Although conventionally very wide in the transverse (y) extent, the continuous transverse stub element 11 may be utilized in reduced width configurations down to and including simple rectangular waveguide. The sidewalls of such a truncated or finite width continuous transverse stub element 11*g* may be terminated in a surface 17 which may be conductive, nonconductive or absorptive using short-circuits, open-circuits, or loads, as dictated by a particular application.

Multi-stage stub element 11*h* and transmission sections 27 are shown in FIG. 12. Multiple stages 18 may be employed in the stub element 11 and/or parallel plates 12, 13 in order to modify coupling and/or broaden frequency bandwidth characteristics of the structure as dictated by specific electrical and mechanical constraints.

Paired-elements 11*i*, 11*j*, comprising a matched couplet, are shown in FIG. 13. Pairs of closely spaced similar continuous transverse stub radiator elements 11 may be employed in order to customize composite antenna element factors (optimized for broadside, endfire, or squinted operation) and/or to minimize composite element VSWR through destructive interference of individual reflection contributions (quarterwave spacing). Likewise, bandpass filter implementations may be realized in a similar fashion when purely-reactive continuous transverse stub elements 11*a*, 11*b* (FIGS. 2 and 3) are employed. Reactive stub elements 11 employ the elements 11*a*, 11*b* shown in FIGS. 2 and 3, for example.

Radiating and non-radiating stub element pair 11*k*, 11*m* comprising a matched couplet 19, are shown in FIG. 14. The non-radiating purely-reactive continuous transverse stub element 11*k* may be paired with the radiating continuous transverse stub radiator element 11*m* as an alternative method for suppression of coupler-radiator reflections through destructive interference of their individual reflection contributions, resulting in a matched continuous transverse stub couplet 19. Such couplets 19 are particularly useful in continuous transverse stub element array antennas where it is required to scan the beam at (or through) broadside.

A double-sided radiator/filter 28 is shown in FIG. 15. Radiator (FIG. 1), coupler (FIG. 4), and/or reactive (FIGS. 2 and 3) stub elements 1 In may be realized on both sides of the parallel plate structure for the purpose of economizing space or for antenna applications in which radiation from both sides of the parallel-plate is desirable.

A radial element 29 is shown in FIGS. 16 and 16*a*, which show cutaway side and top views, respectively. The continuous transverse stub element 11 may be utilized in cylindrical applications in which cylindrical (radial) waveguide modes 28 are employed in place of plane waveguide modes. The continuous transverse stub element 11 forms closed concentric rings 29*a* in this radial configuration with coupling mechanisms and characteristics similar to that for the plane wave case. A single or multiple point source(s) 26 serves as a primary feed. Both radiating and non-radiating reactive versions of the continuous transverse stub element 11 may be realized for the cylindrical case using stub element 11 configurations disclosed above (FIGS. 1–4). Such arrays may be particularly useful for antennas requiring high gain 360 degree coverage oriented ed along the radial (horizon) direction and in one-port filter applications.

Circularly polarized orthogonal elements 11 are shown in FIGS. 17 and 17*a*, which show cutaway side and top views, respectively. Although the continuous transverse stub radiator element is exclusively a linearly polarized antenna element, left and fight hand circular polarization (LHCP, RHCP) is realized in a straightforward fashion either through implementation of a standard quarter-wave plate polarizer (not shown) or through quadrature coupling 30 of orthogonally-oriented continuous transverse stub radiator elements 11 (orthogonal elements 11 ) or arrays.

Arraying of continuous transverse stub coupler/-radiator elements 11 include the following considerations:

Line feed options: As mentioned previously, the continuous transverse stub element 11 may be combined or arrayed in order to form a planar structure fed by an arbitrary line source. This line source may be either a discrete linear array, such as a slotted waveguide, or a continuous linear source, such as a pill-box or sectoral horn. Many conventional line sources may be adapted for use with the present invention, and these are disclosed in the "Antenna Engineering Handbook", edited by Jasik, McGraw-Hill, (1961), particularly chapters 9, 10, 12 and 14. The subject matter of this book is incorporated herein by reference.

Two line sources are used in filter and coupler applications in order to form a two-port device. In the case of antenna applications, a single line feed and line source are utilized in order to impose the desired (collapsed) aperture distribution in the transverse plane (H-plane) while the parameters of individual continuous transverse stub radiator elements 11 are varied in order to control the (collapsed) aperture distribution in the longitudinal plane (E-plane).

Waveguide modes: As an overmoded structure, the parallel plate transmission line 10 within which the continuous transverse stub element(s) 11 reside support a number of waveguide modes which simultaneously meet the boundary conditions imposed by the two conducting plates 12, 13 of the structure. The number and relative intensity of these propagating modes depends exclusively upon the transverse excitation function imposed by the finite line source. Once excited, these mode coefficients are unmodified by the presence of the continuous transverse stub element 11 because of its continuous nature in the transverse plane.

In theory, each of these modes has associated with it a unique propagation velocity which, given enough distance, cause undesirable dispersive variation of the line source-imposed excitation function in the longitudinal propagation direction. However, for typical excitation functions, these mode velocities differ from that of the dominant TEM mode by much less than one percent and the transverse plane excitation imposed by the line source is therefore essentially translated, without modification, over the entire finite longitudinal extent of the continuous transverse stub array structure.

FIG. 18 illustrates the theoretical constant amplitude contours for the x-directed electric field within an air-filled 6 inch by 15 inch parallel plate region fed by a discrete linear array located at $z=0$ and radiating at a frequency of 60 GHz. A cosine-squared amplitude excitation was chosen so as to excite a multitude of odd modes within the parallel plate region. Note the consistency of the imposed transverse excitation over the entire longitudinal extent of the cavity.

Edge and end loading effects: The relative importance of edge effects in the continuous transverse stub array is primarily dependent upon the imposed line-source excitation function, but these effects are in general small because of the strict longitudinal direction of propagation in the structure. In many cases, especially those employing steep excitation tapers, short circuits may be introduced at the edge boundaries with little or no effect on internal field distributions. In those applications for which edge effects are not negligible load materials may be applied as required at the array edges.

In certain applications a second line feed may be introduced in order to form a two-port device, such as a coupler or filter, comprised of continuous transverse stub coupler or reactive elements. For antenna applications either a short circuit, open circuit, or load may be placed at end of the continuous transverse stub array, opposite the line source, in order to form a conventional standing-wave or traveling-wave feed. These will be described in detail below.

Array, coupler, filter synthesis and analysis: Standard array coupler and filter synthesis and analysis techniques may be employed in the selection of inter-element spacings and electrical parameters for individual continuous transverse stub elements 11 in continuous transverse stub array applications. External mutual-coupling effects between radiating stub elements 11 are modeled using standard electromagnetic theory. Normalized design curves relating the physical attributes of the continuous transverse stub element 11 to electrical parameters are derived, either analytically or empirically, in order to realize the desired continuous transverse stub array characteristics.

Design nonrecurring engineering costs and cycle-time: The simple modular design of the continuous transverse stub array concept greatly reduces the design non-recurring engineering costs and cycle-time associated with conventional planar arrays. Typical planar array developments require the individual specification and fabrication of each discrete radiating element along with associated feed components, such as the angle slots, input slots, and corporate feed, and the like. In contrast the continuous transverse stub planar array requires the specification of only two linear feeds one comprised of the array of continuous transverse stub elements 11 and the other comprised of the requisite line-feed. These feeds may be designed and modified separately and concurrently and are fully specified by a minimum number of unique parameters. Drawing counts and drawing complexities are therefore reduced. Design modifications or iterations are easily and quickly implemented.

Fabrication options: Mature fabrication technologies such as extrusion, injection molding and thermo-molding are ideally suited to the fabrication of continuous transverse stub arrays 30. In many cases the entire continuous transverse stub array, including all feed details, may be formed in a single exterior molding operation.

A typical three-step fabrication cycle includes: structure formation, either by continuous extrusion or closed single-step molding; uniform exterior metalization, either by plating, painting, lamination, or deposition; and planar grinding to expose input, output and radiating surfaces. Due to the absence of interior details the continuous transverse stub array requires metallization only on exterior surfaces with no stringent requirement on metallization thickness uniformity or masking.

FIGS. 19 and 19*a*, depict top and side views, respectively, of a typical continuous extrusion process whereby the stubs 11 of the continuous transverse stub array 30 are formed or molded 31, metallized 32, and trimmed 33 in a continuous sequential operation. Such an operation results in long sheets of continuous transverse stub arrays 30 which may subsequently be diced to form individual continuous transverse stub arrays 30. FIG. 20 depicts a similar discrete process by which individual continuous transverse stub arrays 30 are molded or formed 31, metallized 32, and trimmed 33 in a sequence of discrete operations.

As discussed previously the relative insensitivity of the non-resonant continuous transverse stub element 11 to dimensional and material variations greatly enhances its producibility relative to competing resonant approaches. This, in conjunction with the relative simplicity of the design and fabrication of the continuous transverse stub array 30, makes it an ideal candidate for low-cost/high production rate applications.

Continuous transverse stub array applications: A pencil beam antenna array 40 is shown in FIG. 21. A standard pencil beam antenna array 40 may be constructed using the continuous transverse stub array concept with principle plane excitations implemented through appropriate selection of line-source 39 and continuous transverse stub element parameters. Element spacings are conventionally chosen to be approximately equal to an integral number of wavelengths (typically one) within the parallel plate region. Monopulse functions may be realized through appropriate modularization and feeding of the continuous transverse stub array aperture.

A shaped-beam antenna array 41 is shown in FIG. 22. The variable length of the stub portion of the continuous transverse stub element 11 allows for convenient and precise control of individual element phases (resulting from varying the element lengths $I_n$, $l_{n+1}$) in continuous transverse stub antenna array applications. This control in conjunction with the continuous transverse stub element's conventional capability for discrete amplitude variation allows for precise specification and realization of complex shaped-beam antenna patterns. Likewise, nonuniform spacing of continuous transverse stub elements may be employed in order to produce shaped-beam patterns. Examples include cosecant-squared and non-symmetric sidelobe applications.

Exploitation of unused inter-element area: The continuous stubs of a continuous transverse stub array typically occupy no more than 10–20 percent of the total planar antenna aperture and/or filter area. The radiating apertures of these stubs are at their termination and are therefore raised above the ground-plane formed by the main parallel-plate transmission-line 10. Relatively wide continuous transverse conductive troughs 43 are therefore formed between individual continuous transverse stub elements 11 as is depicted in FIG. 23. These troughs 43 may be exploited in order to introduce secondary array structures.

Other exploitations include: closing the trough 43 in order to form a slotted waveguide cavity 44 is shown in FIG. 24; interdigitation of a printed patch array; and slotting of the troughs 43 in order to couple alternative modes from the parallel plate transmission-line 10; or introduction of active elements as adjuncts to the continuous transverse stub array structure.

FIG. 25 is useful in illustrating three different antenna arrays 45. A dual-polarization antenna array 45 is shown in FIG. 25. An identical pair of arrays of orthogonally-oriented continuous transverse stubs 11 may be utilized in order to realize a dual-polarization (orthogonal senses of linear) planar array 45 sharing a common aperture area. Circular or elliptical polarizations may be realized through appropriate combination of these two orthogonal signals coupled to signal inputs 49*a*, 49*b* of the line some 39 using fried or variable quadrature couplers (not shown) or with the introduction of a conventional linear-to-circular polarization polarizer (not shown). The pure linear polarization of individual continuous transverse stubs 11 and the natural orthogonality of the parallel plate waveguide modes provides this approach with superior broadband polarization isolation.

In a manner similar to the aforementioned dual-polarization approach, two dissimilar orthogonally-oriented arrays of continuous transverse stubs 11 may be employed in order to provide a simultaneous dual antenna beam capability provided by a dual-beam antenna array 45. As a specific example, one continuous transverse stub array 11 would provide a vertically-polarized pencil beam for air-to-air radar modes, while the other continuous transverse stub array 11*e* would provide a horizontally-polarized cosecant-squared beam for ground mapping). Dual squinted pencil beams for microwave relay represents a second application of this dual beam capability.

Again utilizing a pair of arrays of orthogonally-oriented continuous transverse stubs 11 a dual-band planar array 45 may be constructed through appropriate selection of inter-element spacings and continuous transverse stub element parameters for each array. The two selected frequency bands may be widely separated due to the dispersionless nature of the parallel plate transmission line structure and the frequency-independent orthogonality of the waveguide modes.

A dual-polarization, dual-beam, dual-band antenna array 46 (multiple modes) shown in FIGS. 26 and 26*a*. Periodically-spaced slots 47 may be introduced in the previously described troughs 43 between individual continuous transverse stub elements 11 in order to couple alternative mode sets from the parallel plate transmission line 10. As an example a $TE_{01}$ mode whose electric field vector is oriented parallel to the conducting plates 12, 13 of the parallel plate transmission line may be selectively coupled through the introduction of thick or thin inclined slots in the inter-element troughs 43 as depicted in FIGS. 26 and 26*a*, which show cutaway side and top views, respectively. These slots 47 may protrude slightly from the conductive plate ground plane (parallel plate 13) in order to aid in fabrication. Such a mode is not coupled by the continuous transverse stub elements 11 due to the transverse orientation of its induced wall currents and the cut-off conditions of the continuous transverse stubs to the $TE_{01}$ mode.

Likewise the waveguide modes of the parallel plate waveguide structure, with its electric field vector oriented perpendicular to the conducting plates 12, 13 of the parallel plate transmission line 10, are not coupled to the inclined slots 47 due to the disparity in operating and slot resonant frequencies particularly for thick (cut-off) slots. In this way a dual-band planar array 46 is formed with frequency band offsets regulated by the inter-element spacing of the continuous transverse stub and inclined slots and the parallel-plate spacing of the parallel plate transmission line 10.

FIGS. 27 and 27*a* depict the electric field components for TEM and $TE_{01}$ modes. Dual-beam and dual-polarization apertures may be realized using intentional multimode operation in a conventional manner.

A squinted-beam antenna array 49 is shown in FIG. 28. An intentional fixed or variable beam squint, in one or both planes, may be realized with a continuous transverse stub array 30 through appropriate selection of the spacing between continuous transverse stub elements 11, constituent material dielectric constant and/or requisite line feed characteristics. Such a squinted array 49 may be desirable for applications in which mounting constraints require deviation between the mechanical boresight and the electrical boresight of the antenna.

Scanning by mechanical line-feed variation with respect to an antenna array 50 is shown in FIGS. 29 and 29*a*, which show top and side views thereof, respectively. The requisite line-feed 39 for a continuous transverse stub antenna array 50 may be mechanically dithered in order to vary the angle of incidence (phase slope) of the propagating parallel plate waveguide modes relative to the continuous transverse stub element axis. In doing so, a refraction-enhanced beam squint (scan) of the antenna beam 51 is realized in the transverse (H-plane) of the array 50.

Scanning by fine-feed phase velocity variation with respect to an antenna array 50 is shown in FIGS. 30 and 30*a*, which show top and side views thereof, respectively. An alternative method for variation of the angle of incidence (phase slope) of the propagating parallel plate waveguide modes relative to the continuous transverse stub element axis is employed. This is achieved through electrical or mechanical variation of the phase velocity within the requisite line-feed by modulation of the constituent properties and/or orientation of the dielectric materials within the waveguide or through modulation of its transverse dimensions. Such variation causes squinting (dithering) of the phase front 51 emanating from the line source while maintaining a fixed (parallel) mechanical orientation relative to the continuous transverse stub element axis.

Scanning and tuning by parallel plate phase velocity variation as shown in FIGS. 30*b*, 30*c*. Variation of the phase velocity within the parallel plate transmission-line 10 scans the beam ($\theta_1$, $\theta_2$) for antenna applications in the longitudinal (E-) plane. Such a variation may be induced through appropriate electrical and/or mechanical modulation of the constituent properties of the dielectric material ($\epsilon_r$) contained within the parallel plate region. Scanning by this technique in the longitudinal plane may be combined with previously mentioned scanning techniques in the transverse plane in order to achieve simultaneous beam scanning in two dimensions. This modulation in phase velocity within the parallel plate transmission-line 10 may also be employed in continuous transverse stub array filter and coupler structures in order to frequency tune their respective responses, including passbands, stopbands, and the like.

Scanning by frequency is shown in FIG. 31. When utilized as a traveling wave antenna array 50, the position (squint) of the antenna mainbeam varies with frequency. In applications where this phenomena is desirable inter-element spacings and material dielectric constant values may be chosen in order to enhance this frequency-dependent effect. As a particular example, a continuous transverse stub array 50 fabricated from a high dielectric material ($\epsilon_r = 12$) exhibits approximately a 2 degree beam scan for a 1 percent variation in operating frequency.

A conformal array 53 is shown in FIGS. 32 and 32*a*, which show side and top views thereof, respectively. The absence of internal details within the continuous transverse stub structure allows for convenient deformation of its shape in order to conform it to curved mounting surfaces, such as wing leading edges, missile and aircraft fuselages, and automobile bodywork, and the like. The overmoded nature of the continuous transverse stub array 50 allows such deformation for large radii of curvature without perturbation of its planar coupling characteristics.

The inter-element troughs 43 in the continuous transverse stub array 53 may provide a means for suppression of undesirable surface wave phenomena normally associated with conformal arrays. Deformation or curvature of the radiated phase front emanating from such a curved continuous transverse stub array, such as the conformal array 53, may be corrected to planar through appropriate selection of line feed 39 and individual continuous transverse stub element 11 phase values.

An endfire array 54 is shown in FIG. 33. The continuous transverse stub array may be optimized for endfire operation (illustrated by arrows 54*a*) through appropriate selection of inter-element spacings and constituent material characteristics. The elevated location, relative to the inter-stub ground plane, of the top surfaces of the individual continuous transverse stub radiator elements 11 affords a broad element factor and therefore yields a distinct advantage to the continuous transverse stub element 11 in endfire applications.

Top, side, and end views, respectively, of a nonseparable shared array 55 are shown in FIGS. 34, 34*a*, and 34*b*. Variation of continuous transverse stub element parameters in the transverse plane yields a quasi-continuous transverse stub element 11*f* which may be utilized in quasi-continuous transverse stub arrays for which nonseparable aperture distributions and/or nonrectangular aperture shapes, such as circular or elliptical, or the like, are desired. For continuous smoothly-varying modulation of quasi-continuous transverse stub element parameters the excitation propagation and coupling of higher order modes within the quasi-continuous transverse stub array structure can be assumed to be locally similar to that of the standard continuous transverse stub array 50 and hence the continuous transverse stub array design equations may be applied locally across the transverse plane in quasi-continuous transverse stub applications.

Low radar cross section potential: The absence of variation in the transverse plane for continuous transverse stub arrays 50 eliminates scattering contributions (Bragg lobes) which would otherwise be present in traditional two-dimensional arrays comprised of discrete radiating elements. In addition the dielectric loading in the continuous transverse stub array 50 allows for tighter (smaller) inter-element spacing in the longitudinal plane and therefore provides a means for suppression or manipulation of Bragg lobes in this plane. The capability to intentionally squint the mainbeam in continuous transverse stub array applications also affords to it an additional design advantage in terms of radar cross section performance.

A radial array 56 is shown in FIGS. 35 and 35*a*, which show top and side views thereof, respectively. In the radial array 56 the continuous transverse (transverse to radially propagating modes) stubs form continuous concentric rings 29. A single or multiple (multimode) point source 24 replaces the traditional line source 39 in such applications. Radial waveguide modes are utilized in a similar manner to plane waveguide modes in order to derive design equations for the radial array 56.

Dual-polarization dual-band and dual-beam capabilities may be realized with the radial array 56 through appropriate selection of feed(s), radial continuous transverse stub elements 29, and auxiliary element characteristics in a manner that directly parallels that for the planar continuous transverse stub array 50. Similar performance application and producibility advantages apply. Both endfire (horizon) and broadside (zenith) mainbeam patterns may be realized with the radial array 56.

Figure 36:
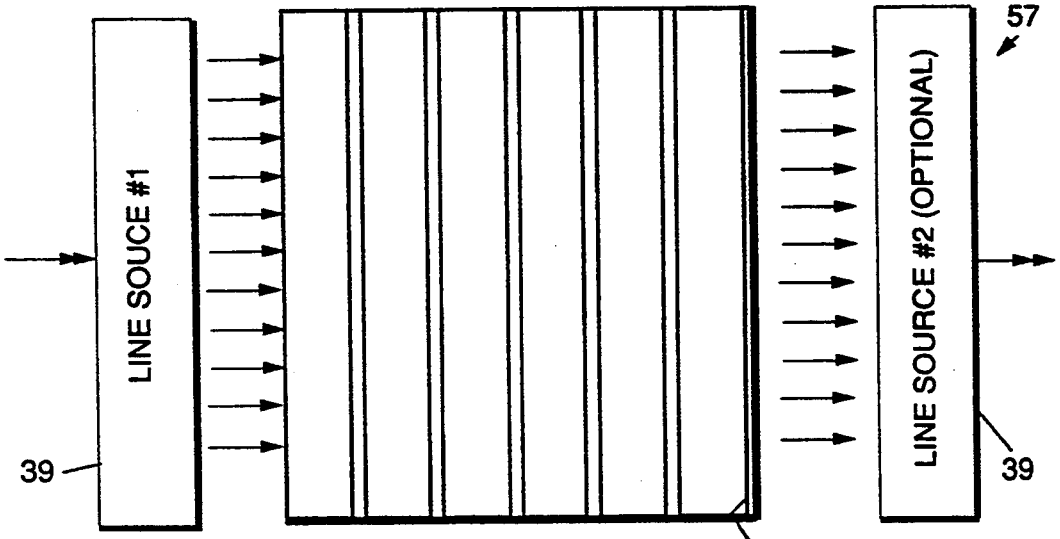
Figure 36A:
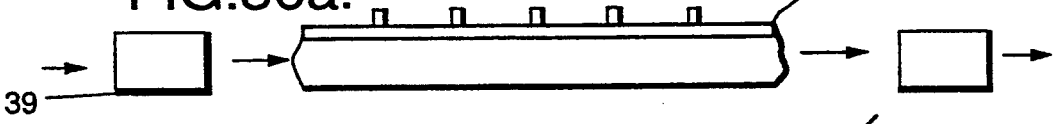
Figure 37:
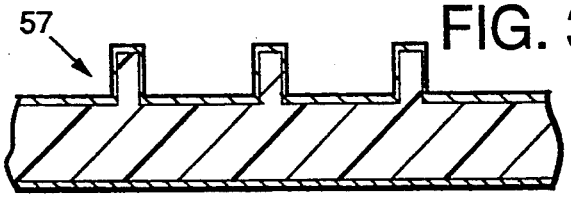
Figure 37A:
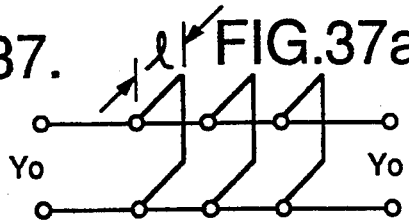

A filter 57 is illustrated in FIGS. 36, 36*a*, and 37, and the corresponding electrical structure is shown in FIG. 37*a*. Nonradiating reactive continuous transverse stub elements, terminated in an open or short circuit, may be arrayed in order to conveniently form filter structures. Such structures function independently as filters or may be combined with radiating elements in order to form an integrated filter-multiplexer-antenna structure. Conventional methods of filter analysis and synthesis may be employed with the continuous transverse stub array filter without loss of generality.

The continuous transverse stub array enjoys advantages over conventional filter realizations particularly at millimeter-wave and quasi-optical frequencies where its diminished dissipative losses and reduced mechanical tolerance sensitivities allow for the efficient fabrication of high precision high-Q devices. Note that the theoretical dissipative losses for the continuous transverse stub array's parallel plate transmission line structure are approximately one-half of those associated with a standard rectangular waveguide operating at the identical frequency and comprised of identical dielectric and conductive materials.

A coupler 59 is illustrated in FIGS. 38, which shows a side view thereof and its corresponding electrical structure, respectively. In a manner similar to filters precision couplers may also be realized and integrated using the continuous transverse stub array 59 with individual continuous transverse stub elements 11 functioning as branch-guide surrogates. In the coupler 59, energy is coupled from the lower parallel plate region to the upper parallel plate region as is indicated by the arrows in FIG. 38. Once again conventional methods of coupler analysis and synthesis may be employed without loss of generality.

Extrusions or multi-layer molding/plating techniques are ideally suited to the realization of continuous transverse stub array couplers 59. Such couplers 59 are particularly useful at higher operating frequencies, including millimeter-wave and quasioptical, where conventional couplers based on discrete resonant elements are extremely difficult to fabricate.

FIG. 39 shows a top view of an embodiment of a continuous transverse stub antenna array 50 made in accordance with the principles of the present invention that was built and tested. FIG. 40 shows a side view of the array 50 of FIG. 39. A 12 by 24 by 0.25 inch sheet of Rexolite ($\epsilon_r$=2.35, $L_t$=0.0003) was machined to form a 6 by 10.5 inch continuous transverse stub antenna array 50 comprised of twenty continuous transverse stub elements 21 designed for operation in the Ku (12.5–18 GHz) frequency band. A moderate amplitude excitation taper was imposed in the longitudinal plane through appropriate variation of continuous transverse stub widths whose individual heights were constrained to be constant. An inter-element spacing of 0.500 inch and a parallel plate spacing of 0.150 inch were employed. A silver-based paint was used as a conductive coating and was uniformly applied over all exposed areas (front and back) of the continuous transverse stub antenna array 50. Input and stub radiator surfaces were exposed after plating using a mild abrasive.

A line source 39 comprising an H-plane sectoral horn 39*a* (a=6.00 inch, b=0.150 inch) was designed and fabricated as a simple Ku-band line source providing a cosinusoidal amplitude and a 90 degree (peak-to-peak) parabolic phase distribution at the input of the continuous transverse stub array 50. A quarter-wave transformer 52 was built into the continuous transverse stub array 50 in order to match the interface between it and the sectoral horn line source.

E-plane (longitudinal) antenna patterns were measured for the continuous transverse stub antenna array 50 over the frequency band of 13 to 17.5 GHz, exhibiting a well-formed mainbeam ($<-13.5$ dB sidelobe level) over this entire frequency range. Cross-polarization levels were measured and found to be better than $-50$ dB. H-plane (transverse) antenna patterns exhibited characteristics identical to that of the sectoral horn, a fact which is consistent with the separable nature of the aperture distribution used for this configuration. FIG. 41 depicts a measured E-plane pattern for this continuous transverse stub array 50 of FIGS. 39 and 40 measured at a frequency of 17.5 GHz.

Thus, it may be seen that, for the case of antennas, a continuous transverse stub array realized as a conductively-plated dielectric has many performance, producibility, and application advantages over conventional slotted waveguide army, printed patch array, and reflector and lens antenna approaches. Some distinct advantages in integrated filter and coupler applications are realized as well.

Performance advantages include: superior aperture efficiency and enhanced filter "Q", achieving less than −0.5 dB/foot dissipative losses st 60 GHz; superior frequency bandwidth, having up to one octave per axis, with no resonant components or structures; superior broadband polarization purity, with −50 dB cross-polarization; superior broadband element excitation range and control, having coupling values from −3 dB to −35 dB per element; superior shaped beam capability, wherein the non-uniform excitation phase is implemented through modulation of stub length and/or position; and superior E-plane element factor using a recessed ground-plane allows for wide scanning capability, even to endfire.

Producibility advantages include: superior insensitivity to dimensional and material variations with less than 0.50 dB coupling variation for 20% change in dielectric constant, no resonant structures; totally "externalized" construction, with absolutely no interval details required; simplified fabrication procedures and processes, wherein the structures may be thermoformed, extruded, or injected in a single molding process, with no additional joining or assembly required; and reduced design nonrecurring engineering costs and cycle-time due to a modular, scalable design, simple and reliable RF theory and analysis, and two-dimensional complexity reduced to one dimension.

Application advantages include: a very thin profile (planar, dielectrically loaded); lightweight (⅓ the density of aluminum); conformal, in that the array may be curved/bent without impact on internal coupling mechanisms; superior durability (no internal cavities or metal skin to crush or dent); dual-polarization, dual-band, and dual beam capable (utilizing orthogonal stubs); frequency-scannable (2 degrees scan per 1% frequency delta for high dielectric materials); electronically-scannable using an electronically- or electromechanically-scanned line feed; reduced radar cross section providing a one dimensional "compact" lattice; it is applicable at millimeter-wave and quasi-optical frequencies, with extremely low dissipative losses, and enhanced tolerances; and it provides for integrated filter, coupler, and radiator functions, wherein the filter, coupler and radiator elements may be fully integrated in common structures.

Thus there has been described a new and improved continuous transverse stub element. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A shaped-beam antenna array employing continuous transverse stubs as radiating elements comprising:

a planar sheet of dielectric material having two generally parallel broad surfaces separated by a predetermined distance and having a plurality of elongated, raised, relatively thin, rectangular dielectric members formed along a broad surface of the sheet of dielectric material that extend across one dimension of the broad surface and that extend away from the broad surface, and wherein the plurality of thin rectangular dielectric members are spaced apart from each other by a predetermined distance and wherein the rectangular dielectric members vary in length; and a conductive material disposed on the broad surfaces of the sheet of dielectric material and on transversely extending edgewalls formed by the plurality of thin rectangular dielecteric members so as to define a parallel plate waveguide having a plurality of continuous variable length transverse stubs disposed on one plate thereof, and wherein distal ends of the plurality of thin rectangular dielectric members are free of the conductive material so as to define a plurality of radiating elements, and wherein an edge of the sheet of dielectric material is free of conductive coating so as to define a feed for the shaped-beam antenna array, whereby precise control of individual phase elements result from the variable length transverse stubs.

2. The squinted-beam antenna array of claim 1 wherein line-feed phase velocity variation with respect to the antenna array is used to scan the squinted-beam antenna array.

3. The squinted-beam antenna array of claim 1 wherein parallel plate phase velocity variation is used to scan the squinted-beam antenna array.

4. The squinted-beam antenna array of claim 1 wherein parallel plate phase velocity variation is used to tune the squinted-beam antenna array.

5. The squinted-beam antenna array of claim 1 wherein scanning by frequency is used to scan the squinted-beam antenna array.

6. A squinted-beam antenna array employing continuous transverse stubs as radiating elements comprising:

a planar sheet of dielectric material having two generally parallel broad surfaces separated by a predetermined distance and having a plurality of elongated, raised, relatively thin, rectangular dielectric members formed along a broad surface of the sheet of dielectric material that extend across one dimension of the broad surface and that extend away from the broad surface, and wherein the plurality of thin rectangular dielectric members are spaced apart from each other in a predetermined selection of spacing; and a conductive material disposed on the broad surfaces of the sheet of constituent material dielectric constant and on transversely extending edgewalls formed by the plurality of thin rectangular dielectric members so as to define a parallel plate waveguide having a plurality of continuous transerse stubs disposed on one plate thereof, and wherein distal ends of the plurality of thin rectangular dielectric members are free of the conductive material so as to define a plurality of radiating elements, and wherein an edge of the sheet of dielectric material is free of conductive coating so as to define a feed for the squinted-beam antenna array, whereby a predetermined beam squint is realized.

7. A conformal antenna array employing continuous transverse stubs as radiating elements comprising:

a planar sheet of dielectric material having two generally parallel broad surfaces separated by a predetermined distance and having a plurality of elongated, raised, relatively thin, rectangular dielectric members formed along a broad surface of the sheet of dielectric material that extend across one dimension of the broad surface and that extend away from the broad surface, and wherein the plurality of thin rectangular dielectric members are spaced apart from each other by a predetermined distance and inter-member troughs are formed between each of the members of the plurality of thin rectangular dielectric members; and a conductive material disposed on the broad surfaces to the sheet of dielectric material and on transversely extending edgewalls formed by the plurality of thin rectangular dielectric members so as to define a parallel plate waveguide having a plurality of continous transverse stubs disposed on one plate thereof, and wherein distal ends of the plurality of thin rectangular dielectric members are free of the conductive material so as to define a plurality of radiating elements, and wherein an edge of the sheet of dielectric material is free of conductive coating so as to define a feed for the antenna array, whereby the inter-member troughs provide a means of suppressing surface wave phenomena.

8. A method of making a continuous transverse stub antenna element which comprises the following steps:

molding a sheet of dielectric material to form an integral dielectric member having two generally parallel broad surfaces and at least one elongated raised relatively thin rectangular dielectric portion extending transversely across one of the broad surfaces;

metalizing the exterior surfaces of the dielectric member to define a parallel plate waveguide having at least one continous transverse stub disposed on one plate thereof; and trimming from predetermined surfaces of the exterior of the parallel plate waveguide to permit coupling of energy into and out of the antenna element.

* * * * *